US005282317A

United States Patent [19]

Carter et al.

[11] Patent Number: 5,282,317

[45] Date of Patent: Feb. 1, 1994

[54] TISSUE PATTERN PAPER

[76] Inventors: Doris Carter, P.O. Box 6121, Lubbock, Tex. 79493; Georgia Brewer, 1932 70th, Lubbock, Tex. 79412

[21] Appl. No.: 886,047

[22] Filed: May 19, 1992

[51] Int. Cl.[5] ..... G01B 5/26; A41H 1/00; A41H 3/00

[52] U.S. Cl. ..... 33/1 B; 33/12; 33/563

[58] Field of Search ..... 33/1 B, 1 BB, 11, 12, 33/14, 16, 563

[56] References Cited

U.S. PATENT DOCUMENTS

| | | | |
|---|---|---|---|
| 121,128 | 11/1871 | Rehn | 33/1 B |
| 1,189,277 | 7/1916 | Martens | 33/1 B |
| 1,205,879 | 11/1916 | Felten | 33/1 B |
| 2,610,413 | 9/1952 | Dasey | 33/563 |
| 3,711,951 | 1/1973 | Seiler | 33/12 |
| 4,205,446 | 6/1980 | Gibson | 33/12 |
| 4,224,740 | 9/1980 | Gibson | 33/12 |
| 4,779,346 | 10/1988 | Schafer | 33/1 B |
| 4,827,621 | 5/1989 | Borsuk | 33/1 B |
| 4,860,456 | 8/1989 | Arnao | 33/1 B |

FOREIGN PATENT DOCUMENTS

| | | | |
|---|---|---|---|
| 529509 | 6/1955 | Italy | 33/1 B |
| 1578521 | 11/1980 | United Kingdom | 33/1 B |

OTHER PUBLICATIONS

"K & E Graph Sheets Coordinate Papers and Cloths'-'-Keuffel & Esser Co. Jun. 1952, pp. 46, 47 and 58.

*Primary Examiner*—Thomas B. Will
*Assistant Examiner*—C. W. Fulton

[57] ABSTRACT

A general-purpose device of different sizes so as to accommodate use by a person, primarily, in the altering of, and the making of, all or part of a tissue paper pattern. The device is comprised of a sheet made of tissue paper material (1) on which one side of the sheet comprises a series of straight lines ruled equal distance apart vertically (2) and horizontally (3). Some of the vertical (4) and horizontal (5) lines may, at certain intervals, be more heavily marked than the rest of the lines and so stand out from the rest of the lines thereby facilitating measuring. These heavier marked lines may be numbered consecutively vertically (6) and horizontally (7) when there is a need or demand, or both, by the public for such numbering.

15 Claims, 2 Drawing Sheets

TISSUE PATTERN PAPER

SUMMARY OF THE INVENTION

The invention relates to a general-purpose device for, primarily, the altering of, and the making of, all or part of a tissue paper pattern, thereby facilitating the process by which the altering of, and the making of, all or part of a tissue paper pattern can be done.

The primary object of the invention is to provide the public with a general-purpose device which comprises the means whereby all or most of the steps necessary in the altering of, and in the making of, all or part of a tissue paper pattern can be done with one device rather than requiring the combination or assortment of devices and means currently on the market for the altering of, and the making of, all or part of a tissue paper pattern; such device being simple to use, easy to store, and inexpensive to buy.

DETAILED DESCRIPTION OF THE INVENTION

Figure 1:
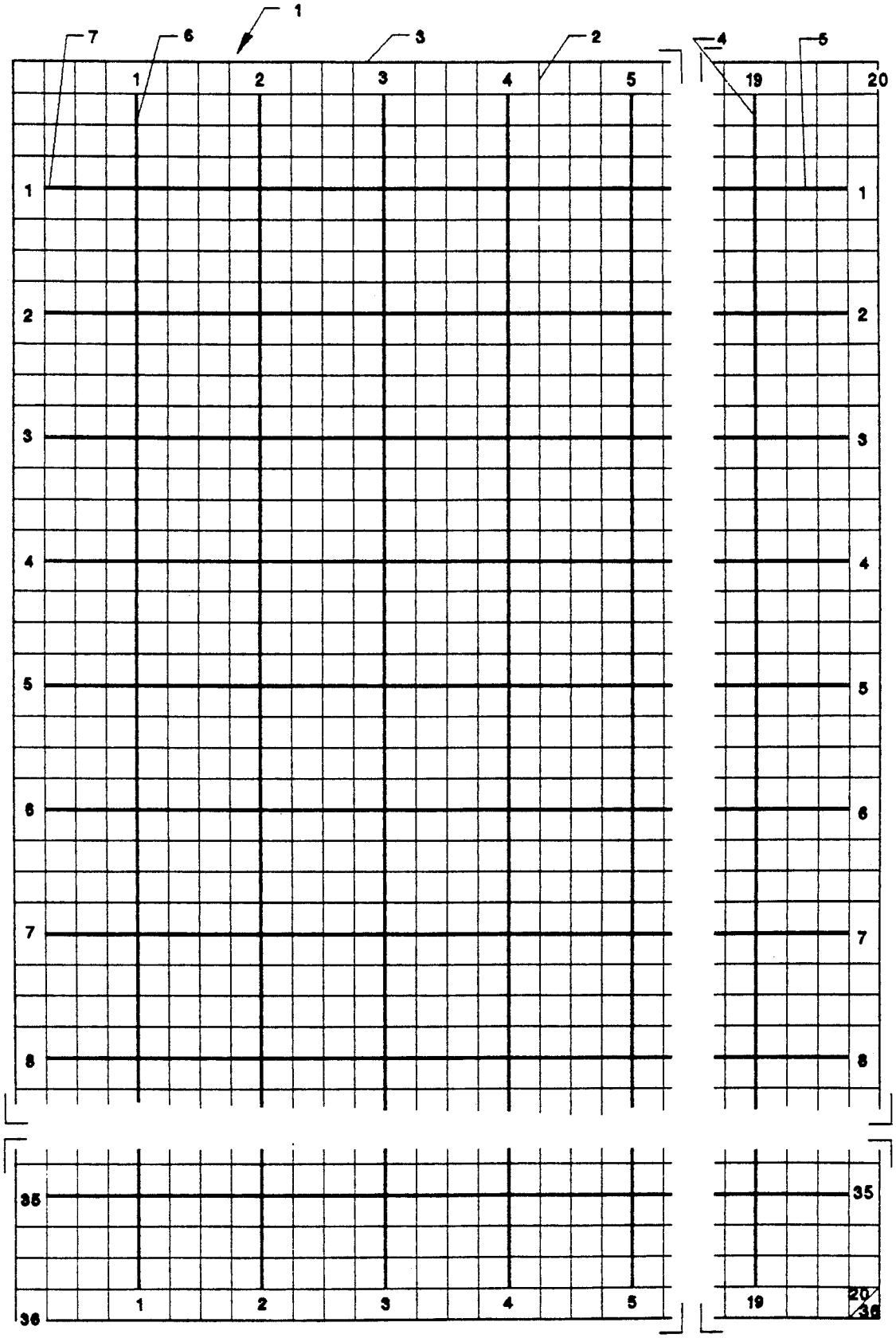
FIG. 1 is a view of a larger sized sheet of Tissue Pattern Paper designed for the Customary/English System of Measurement on which a vertical and horizontal blank space is shown on the sheet to represent the lines and numbers omitted because of space limitation.
Figure 2:
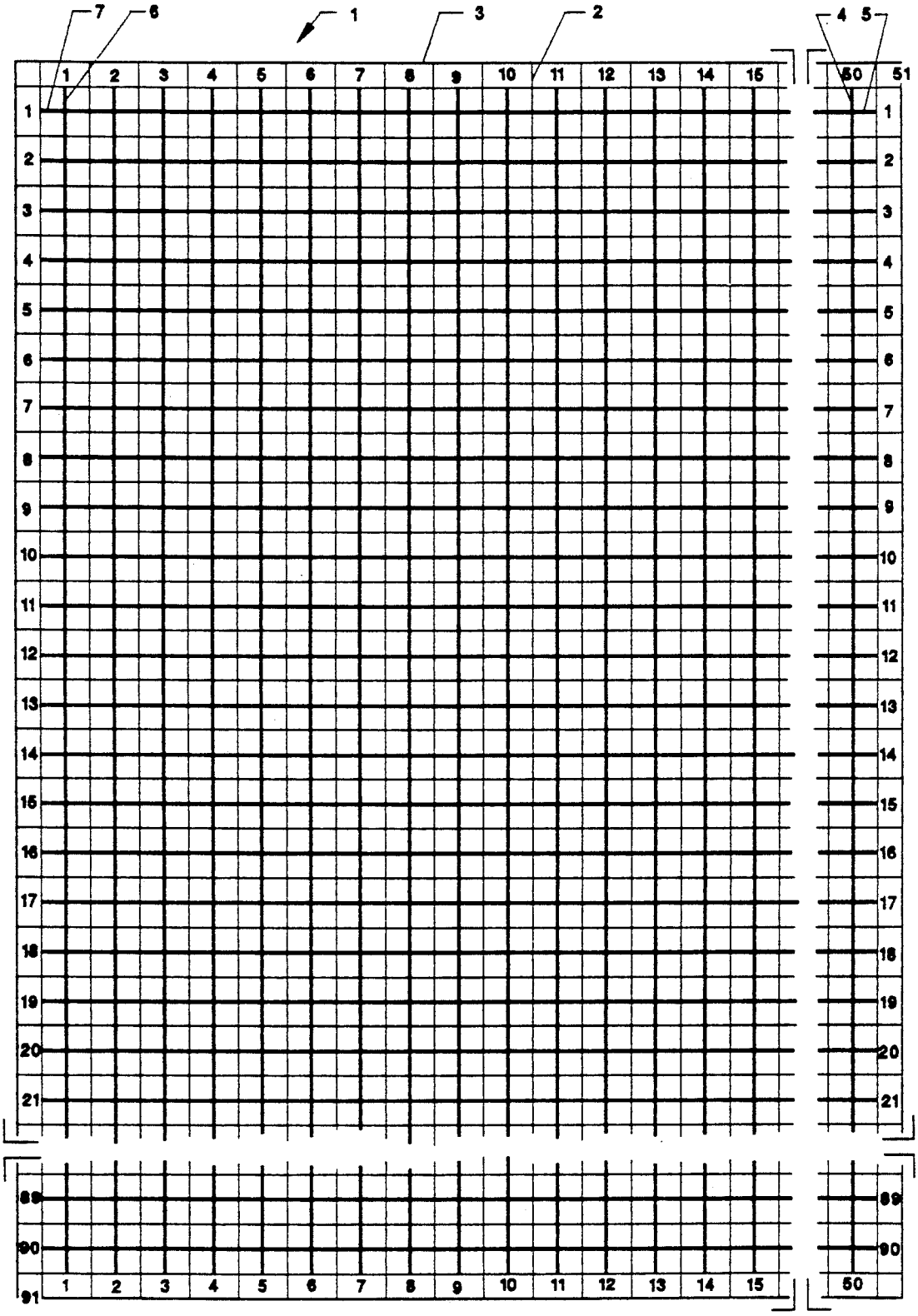
FIG. 2 is a view of a larger sized sheet of Tissue Pattern Paper designed for the Metric System of Measurement on which a vertical and horizontal blank space is shown on the sheet to represent the lines and numbers omitted because of space limitation.

Referring to FIGS. 1 and 2, an embodiment of Tissue Pattern Paper is shown. In the respective FIGS., Tissue Pattern Paper 1 comprises a sheet made of tissue paper material measuring 20 by 36 inches (FIG. 1) and 51 by 91 centimeters (FIG. 2), on which there are a series of straight lines ruled ¼ inch (FIG. 1) and ½ centimeter (FIG. 2) apart, vertically 2 and horizontally 3. Every line that equals a measurement of 1 inch (FIG. 1) and 1 centimeter (FIG. 2), vertically 4 and horizontally 5, has a heavier marking than the rest of the lines so as to stand out from the rest of the lines to facilitate measuring. Beginning at the first heavier marked line, vertically 6 and horizontally 7, and each heavier marked line thereafter, the lines are, starting with number 1, numbered consecutively on the border of the four sides of the Tissue Pattern Paper.

Because the body measurements of most commercial tissue paper patterns sold today are in proportion, but the bodies of most people buying the patterns are not, alterations ranging from minor to major are required on the patterns before they can be used in making good fitting garments for the people using them.

Commercial tissue paper patterns give very few body measurements, and those that are given, are for use in selecting a pattern size closest to one's body measurements. For example: A size 14 pattern would normally show a waist size of 28 inches (71 cm) and a hip size of 38 inches (97 cm). But these waist and hip sizes are of little use in altering a pattern because how much of the 28 inches (71 cm) and 38 inches (97 cm) are for the front of the waist and hips and how much for the back are not known and must be known before comparison can be made with a person's corresponding body parts. The front half of a person's waist/hips, like the front half of so many other parts of the body, seldom, if ever, measure the same as the corresponding back half.

The first step, therefore, in altering one of the above patterns is to measure the various parts of the pattern so that comparison can be made to the corresponding body parts. For instance, a dress pattern where the top (bodice) and skirt join at the waist would require the taking of many measurements if a good fitting garment were later to be made from it. The measurements required would be as follows: (1) the various parts of the front top (bodice) pattern piece would have to be measured (the neck, shoulder length, bust, waist, shoulder to waist, center front, plus other measurements depending on the design of the pattern), (2) the various parts of back top (bodice) pattern piece, and (3) the various parts of the front skirt pattern piece and (4) the various parts of the back skirt pattern piece.

If the various parts were measured with a measuring tape, a ruler, a measuring device in combination with another measuring device, or some other current means of measuring, the process would be time consuming for, by and large, each part would have to be measured separately.

One advantage of Tissue Pattern Paper is that it greatly reduces the time it takes to measure a pattern piece for the user of the pattern piece has simply to place the pattern piece on top of an accommodating sized sheet of Tissue Pattern Paper and practically any measurement needed can be seen almost at a glance. Measuring the various parts of the pattern pieces of the above dress pattern with Tissue Pattern Paper would take far less time than it would if the same measurements were taken with the current measuring means available to the public.

Tissue Pattern Paper not only saves time when measuring, but when doing the actual alteration/s as well. For example: The pattern manufacturer states on the pattern the length of "finished back from waist" of the above skirt is 27½ inches (69.85 cm). The pattern user in measuring the back skirt pattern piece with Tissue Pattern Paper noted the bottom edge of the skirt rested on the 29½ inch (74.93 cm) line of the Tissue Pattern Paper. Thus the skirt had a hem of 2 inches (5.08 cm). The user decides to lengthen the skirt 1½ inches (3.81 cm). The advantage of doing this alteration with Tissue Pattern Paper rather than without it is as follows:

With Tissue Pattern Paper, the user would:

(1) Cut the front (later the back) skirt pattern piece in two where the pattern manufacturer designates the pattern piece should be cut for lengthening or shortening (2) Move the bottom edge of the skirt pattern piece from the 29½ inch (74.93 cm) line on the Tissue Pattern Paper to the 31 inch (78.74 cm) line OR the user could insert a scrap strip of Tissue Pattern Paper containing 6 of the ¼ inch (6.3 cm) units (for a total of 1½ inches or 74.93 cm) between the two cut edges (3) Tape the 1½ inch (3.81 cm) strip of Tissue Pattern Paper now between the two cut sections to the sections (4) Cut away the unused portion of the Tissue Pattern Paper.

Without Tissue Pattern Paper, the user would:

(1) Do step 1 above (2) Tape a strip of plain tissue paper to one of the edges of the two cut sections (3) With a measuring tape, ruler, or some other measuring device, measure 1½ inches (3.81 cm) out from one cut edge and mark measurement (mark in two places for accuracy) on the plain tissue paper
(4) Place the edge of the other cut section on the marks
(5) Tape the 1½ inch (3.81 cm) strip of plain tissue paper now between the two cut sections to the sections
(6) Cut away the unused portion of the Tissue Pattern Paper.

By using Tissue Pattern Paper, two steps in the process of lengthening a skirt have been eliminated while at the same time insuring greater accuracy of measurement than if done without Tissue Pattern Paper because the user could, for example, have measured 1½ inches (3.81 cm) for one mark and 1¼ inches (3.18 cm) for the other mark, an easy mistake, which when realized would take time to correct.

Besides lengthening the skirt, the user needs to enlarge the front skirt pattern piece to allow for her protruding stomach and thus insure that the skirt side seams hang straight rather than swing to the front as often happens when there is a stomach protrusion. Comparison of the user's body measurements to the pattern measurements show the stomach area of the skirt pattern piece needs to be enlarged ¾ inch (1.90 cm) where the stomach protrudes the most, that being 3¼ inches (8.25 cm) down from the waist at center front. The steps involved in doing this alteration with and without Tissue Pattern Paper are as follows:

With Tissue Pattern Paper

Using the lines and measurements on the Tissue Pattern Paper, the user would:
(1) Cut the front skirt pattern piece horizontally along the 3¼ inch (8.25 cm) line of the Tissue Pattern Paper from center front to, but not through, the side seam
(2) Spread the cut ¾ inch (1.9 cm) on Tissue Pattern Paper at center front thereby leaving the spread to taper out to nothing at the side seam since the user's body measurement and the pattern piece measurement are the same at that point
(3) Tape the cut edges to the Tissue Pattern Paper
(4) Cut away the unused portion of the Tissue Pattern Paper.

Without Tissue Pattern Paper

Since pattern manufacturers don't designate a line on a skirt pattern piece for stomach alterations, the user would have to:
(1) Measure down 3¼ inches (8.25 cm) from waist at center front and at the side seam, and mark measurements
(2) Draw a line connecting the marks
(3) Cut along the drawn line from center front to, but not through, the side seam
(4) Tape plain tissue paper along the edge of one of the cuts
(5) At center front measure from cut ¾ inch (1.9 cm) on plain tissue paper and mark
(6) At center front place the other cut edge on the mark
(7) Tape the other cut edge to the plain tissue paper
(8) Cut away any unused plain tissue paper.

The advantage of using Tissue Pattern Paper over not using it for the above alterations is obvious in that Tissue Pattern Paper comprised (1) the measurements, (2) the lines for alignment, and (3) the tissue material needed to lengthen/enlarge the pattern pieces. As a result, the alterations could be done (1) faster, (2) easier, and (3) with a greater assurance of accuracy as a whole, with the use of Tissue Pattern Paper.

Whether it's enlarging a pattern piece as above, or reducing a pattern piece, it is advantageous to use Tissue Pattern Paper because Tissue Pattern Paper comprises the means to do an enlargement or reduction of a pattern piece faster, easier, and with a greater assurance of accuracy than if done without it.

For the most part, doing alterations with the use of Tissue Pattern Paper involves cutting pattern pieces where normally they would be cut for certain alterations, then moving the pattern pieces up or down, in or out, on an accommodating sized sheet of Tissue Pattern Paper until the pieces are placed at the desired measurement.

But the advantage of using Tissue Pattern Paper is not limited to the altering of all or part of a tissue paper pattern. Another advantage is it enables the user to change the design of parts of the pattern without changing the original pattern. For example: If a user has a good fitting dress pattern with a round neck and straight skirt and wants to use the pattern to make an after-five dress with a Vee neck and a full skirt, the user can do so easily with Tissue Pattern Paper.

For the neck, the user would simply place a sheet of Tissue Pattern Paper on top (not under as in the case for alterations) of the front top (bodice) dress pattern piece so that a line on the Tissue Pattern Paper lines up with the center front line on the pattern piece. Using the center front line on the pattern piece, pinpoint on the Tissue Pattern Paper the desired depth of the Vee. Using the shoulder and neck lines on the pattern piece, pinpoint on the Tissue Pattern Paper, the desired width of the Vee. Connect the pinpoints. Starting at width of Vee on shoulder, trace along shoulder about 1½ (3.81 cm) to 2 inches (5.08 cm). At depth of Vee on center front, trace down about 1½ (3.81 cm) to 2 inches (5.08 cm). Draw a diagonal line connecting end of lines. Tissue Pattern Paper will now show a portion of the front top (bodice) pattern piece with a Vee neck. This "alternate" Vee neck pattern piece when cut out of the Tissue Pattern Paper, will later be lined up with the appropriate lines on the pattern piece when the latter is used to make the dress. The round neck and surrounding area on the original pattern piece will simply be folded back to make room for the alternate Vee shaped neck pattern piece.

As for the full skirt, two or more sheets of Tissue Pattern Paper would be taped together and lined up on top of the front skirt pattern piece. Marks designating desired fullness of the skirt would be marked on the Tissue Pattern Paper and lines drawn connecting the marks. The waist line would be traced from the skirt pattern piece on to the Tissue Pattern Paper thereby making a new alternate front skirt pattern piece with a full skirt. The steps would be repeated for the alternate back skirt pattern piece.

To make the above alternate neck and skirt pattern pieces with the use of plain tissue paper and the current measuring devices and means for making such alternate pattern pieces, would take more time, be more difficult, and wouldn't have the assurance of overall accuracy that it would otherwise have with the use of Tissue Pattern Paper.

Another advantage of Tissue Pattern Paper is those people who don't like to cut on the original pattern to make alterations or changes of any kind don't have to.

Some people like to use a pattern more than once, particularly if it is an expensive pattern, so don't like to cut the original pattern in any way, especially if major alterations are needed to be made on it. One example of this is when a person's measurements fluctuate because of weight gain or loss. Because the original pattern is made of tissue paper, it is not likely to hold up if too many alterations have to be made on it each time it is used. Therefore, those pieces of the pattern where the major alterations would be needed can be transferred on to the Tissue Pattern Paper. The transferred pieces then act as the original pieces and the alterations are made on them with the use of other sheet/s of Tissue Pattern Paper.

Another advantage of Tissue Pattern Paper is that a person can, with the use of Tissue Pattern Paper, make a pattern from imagination, a picture, a piece of clothing, or whatever else the idea for a pattern comes from. For example: If a woman saw a picture of a blouse she liked and wanted to make, she could pinpoint her front body measurements on an accommodating sized sheet of Tissue Pattern Paper, allowing for ease, drape or other design allowance, plus seam allowance. She could then connect the pinpoints while at the same time drawing the pattern piece. Likewise, she could do the same for the back pattern piece.

Another advantage of Tissue Pattern Paper is that it can accommodate the user's needs in terms of big or small. Because of its units of measurement and lines, two or more sheets of Tissue Pattern Paper can be easily joined together without affecting the accuracy or function of the Tissue Pattern Paper in any way. Likewise, a sheet of Tissue Pattern Paper can be decreased to the smallest of sizes without accuracy or function being affected.

Another advantage of Tissue Pattern Paper is that there is little or no waste with it. Any unused portion, big or small, of a sheet of Tissue Pattern Paper, because of the units of measurements and lines, can be used for a variety of alterations, as well as for making a variety of patterns and pattern pieces, including small pattern-/pattern pieces such as doll clothing pattern/pattern pieces.

Another advantage of Tissue Pattern Paper is that its use is not limited to the field of apparel, be that male or female, children or adult apparel. The field of crafts is but one of many other fields where the use of Tissue Pattern Paper would be advantageous.

Still another advantage of Tissue Pattern Paper is that it is a general-purpose device, that being it is designed or adaptable for more than one use. Example: A man wants an alteration person to change his ready-made flared-legged trousers to straight-legged. With the use of Tissue Pattern Paper, the alteration person could line a leg seam up on the Tissue Pattern Paper and immediately know how much flare would have to be removed to make the trousers straight-legged.

Because Tissue Pattern Paper is a general-purpose device, all of its uses and advantages are too numerous to mention.

But aside from its many uses and advantages, Tissue Pattern Paper has an advantage in that it is simple to use, easy to store and inexpensive to buy.

We claim:

1. A method of altering and making a tissue pattern with a sheet made of tissue paper material comprising a plurality of intersecting lines running across the width and length of said sheet, said lines being spaced apart a known distance whereby when a pattern piece or design is placed on said sheet, the lines serve as an easy and ready measure, as well as serving as cutting lines, guidelines, grain lines, and center front lines, for the altering and making of the tissue pattern wherein the method for altering, comprises:

A. placing tissue pattern piece on top of said sheet; and

B. using heavy numerically numbered lines or squares formed of said intersecting lines, and any part of a said square thereof, on said sheet, measuring at least one part of said pattern piece; and C. comparing at least one part of said pattern piece measurements with user's corresponding body part/s measurements, and if there is a difference between said part/s and said difference involves enlarging said pattern piece requiring cutting of said pattern piece, said method comprises:

using said heavy numerically numbered lines or said squares formed of said interesting lines, and any part of a said square thereof, on said sheet, locating the place on said pattern piece where enlargement and cut/s are needed; and using one or more said lines as a cutting line/s or guideline/s, cutting said pattern piece as necessary; and using said heavy numerically numbered lines or said squares formed of said intersecting lines, and any part of a said square thereof, on said sheet, spreading the cut sections of said pattern piece on said sheet, the amount of enlargement needed; and taping said cut sections of said pattern piece to portion of said sheet used for said enlargement; and cutting away now enlarged said pattern piece from said sheet when all alterations on said pattern piece have been completed.

2. The method of claim 1 wherein the said known distance apart at which the said plurality of said intersecting lines are spaced is a fraction of an inch, such as ¼ of an inch, with the inch line heavy.

3. The method of claim 2 wherein every said inch line is numbered consecutively, beginning with number 1.

4. The method of claim 1 wherein the said known distance apart at which the said plurality of said intersecting lines are spaced is a fraction of a centimeter, such as ½ centimeter, with the centimeter line heavy.

5. The method of claim 4 wherein every said centimeter line is numbered consecutively, beginning with number 1.

6. A method of altering and making a tissue pattern with a sheet made of tissue paper material comprising a plurality of intersecting lines running across the width and length of said sheet, said lines being spaced apart a known distance whereby when a pattern piece or design is placed on said sheet, the lines serve as an easy and ready measure, as well as serving as cutting lines, guidelines, grain lines, and center front lines, for the altering and making of the tissue pattern wherein the method for altering, comprises:

A. placing tissue pattern piece on top of said sheet; and

B. using heavy numerically numbered lines or squares formed of said intersecting lines, and any part of a said square thereof, on said sheet, measuring at least one part of said pattern piece; and C. comparing at least one part of said pattern piece measurements with user's corresponding body part/s measurements, and if there is a difference between said part/s and said difference involves reducing said pattern piece requiring cutting of said pattern piece, said method comprises:

using said heavy numerically numbered lines or said squares formed of said intersecting lines, and any part of a said square thereof, on said sheet, locating place on said pattern piece where reduction and cut/s are needed; and using one or more said lines on said sheet as a cutting line/s or guideline/s, cutting said pattern piece as necessary; and using said heavy numerically numbered lines or said squares formed of said intersecting lines, and any part of a said square thereof, on said sheet, lapping one cut section of said pattern piece over the other cut section on said sheet the amount of reduction needed, and taping in place.

7. The method of claim 6 wherein the said known distance apart at which the said plurality of said intersecting lines are spaced is a fraction of an inch, such as ¼ of an inch, with the inch line heavy.

8. The method of claim 7 wherein every said inch line is numbered consecutively, beginning with number 1.

9. The method of claim 6 wherein the said known distance apart at which the said plurality of said intersecting lines are spaced is a fraction of a centimeter, such as ½ centimeter, with the centimeter line heavy.

10. The method of claim 9 wherein every said centimeter line is numbered consecutively, beginning with number 1.

11. A method of altering and making a tissue pattern with a sheet made of tissue paper material comprising a plurality of intersecting lines running across the width and length of said sheet, said lines being spaced apart a known distance whereby when a pattern piece or design is placed on said sheet, the lines serve as an easy and ready measure, as well as serving as cutting lines, guidelines, grain lines, and center front lines, for the altering and making of the tissue pattern wherein the method for making a tissue pattern, such as a front blouse pattern piece, comprises:

using zero vertical line on said sheet as guideline for center front of said blouse pattern piece; and using heavy numerically numbered lines, or squares formed of said intersecting lines, and any part of a said square thereof, on said sheet, marking user's front body measurements such as center front length, neck, shoulder, arm hole, bust, waist, on said sheet, allowing for ease, drape, as well as seam allowance; and connecting the said marks to form a front blouse pattern piece on said sheet; and cutting said front blouse pattern piece from said sheet.

12. The method of claim 11 wherein the said known distance apart at which the said plurality of said intersecting lines are spaced is a fraction of an inch, such as ¼ of an inch, with the inch line heavy.

13. The method of claim 12 wherein every said inch line is numbered consecutively, beginning with number 1.

14. The method of claim 11 wherein the said known distance apart at which the said plurality of said intersecting lines are spaced is a fraction of a centimeter, such as ½ centimeter, with the centimeter line heavy.

15. The method of claim 14 wherein every said centimeter line is numbered consecutively, beginning with number 1.

* * * * *